US007040996B2

(12) United States Patent
Grandin

(10) Patent No.: US 7,040,996 B2
(45) Date of Patent: May 9, 2006

(54) CUE TIP CAP

(76) Inventor: Mark Grandin, P.O. Box 321, Columbus, TX (US) 78934

( * ) Notice: Subject to any disclaimer, the term of this patent is extended or adjusted under 35 U.S.C. 154(b) by 50 days.

(21) Appl. No.: 10/811,575

(22) Filed: Mar. 29, 2004

(65) Prior Publication Data

US 2005/0215334 A1 Sep. 29, 2005

(51) Int. Cl.
*A63D 15/12* (2006.01)

(52) U.S. Cl. ..... 473/46

(58) Field of Classification Search ..... 473/44–49
See application file for complete search history.

(56) References Cited

U.S. PATENT DOCUMENTS

| | | | | | |
|---|---|---|---|---|---|
| 437,746 | A * | 10/1890 | Barber | 473/36 |
| 1,444,093 | A * | 2/1923 | Atkins | 473/49 |
| 1,605,240 | A * | 11/1926 | Johnson | 473/49 |
| 4,314,575 | A * | 2/1982 | Kuo | 135/66 |
| 4,471,824 | A * | 9/1984 | Zownir | 144/330 |
| 5,062,636 | A | 11/1991 | Rahn | |
| 5,351,703 | A | 10/1994 | Moe et al. | |
| 5,407,197 | A * | 4/1995 | Parsons | 463/47.7 |
| 5,725,436 | A | 3/1998 | Miller et al. | |
| 6,227,980 | B1 * | 5/2001 | Costain et al. | 473/46 |
| 6,343,995 | B1 | 2/2002 | Green, Jr. et al. | |
| 6,406,388 | B1 * | 6/2002 | Davis et al. | 473/538 |
| 2004/0082397 | A1 * | 4/2004 | Verona | 473/49 |

* cited by examiner

*Primary Examiner*—Mark S. Graham
(74) *Attorney, Agent, or Firm*—Mary J. Gaskin

(57) ABSTRACT

A cue tip cap that protects the tip of a pool cue stick and also keeps chalk dust on the tip of the cue stick from flaking off into the carrying case. The cue tip cap comprises a sleeve made of a flexible material that snugly grips the end of the cue stick, covering its tip. A decorative knob on one end of the sleeve enables a person to pull the sleeve off the cue stick. The sleeve has grooves or splines on its inner surface to allow air to escape when it is pushed onto the cue stick. The sleeve can further include felt or cork to protect the tip of the cue stick from a stud that may be used to hold the knob to the sleeve.

8 Claims, 4 Drawing Sheets

CUE TIP CAP

BACKGROUND OF THE INVENTION

This invention pertains to a protective device, and more particularly to a device that protects the tip of a pool cue stick.

DESCRIPTION OF PRIOR ART

The games of pool and billiards are well known. Thousands of persons of all skills play the games either occasionally or as a regular hobby.

It is a common practice for pool halls, taverns, and similar establishments to supply a number of cue sticks for their patrons to use. Such cue sticks, although usually of modest quality, are adequate for the occasional player. Serious players, however, invariably purchase their own cue sticks, often at considerable expense. High quality cue sticks can cost $800 and more. To protect their investments, persons owning expensive cue sticks usually purchase carrying cases for them. Some carrying cases are themselves expensive, being made with a hard protective outer shell and including a hinged cover. An attractive and protective material lines the case and snugly grips the cue stick placed in it.

Because of the expense of hard shell carrying cases, players take efforts to maintain their attractive appearance. However, a problem exists regarding the chalk that is routinely used on cue stick tips. When a cue stick is returned to its case, the chalk on the tip flakes off and falls into the carrying case. The result, especially over time, is an unsightly coating of chalk dust on the lining of the carrying case.

Some rather inexpensive carrying cases are designed with soft sides and zipper openings. When the cue stick is placed in such a case, its tip is not fully protected against hard blows.

An inherent limitation of a cue stick carrying case is that it protects a cue stick only when the cue stick is actually in the case. There are numerous times, especially during games, when a player carries his cue stick or sets it down without putting it in its case. During those times, the cue stick tip is vulnerable to striking an object and being damaged.

Thus, a need exists to adequately protect both the tips of cue sticks and the lining of their carrying cases.

SUMMARY OF THE INVENTION

In accordance with the present invention, a cue tip cap is provided that protects both the tip of a cue stick and the lining of the cue stick's carrying case. This is accomplished by a device that includes a blind sleeve with a knob at the sleeve closed end.

The sleeve is made of a fairly pliable material such as rubber or soft plastic. The sleeve has an outer surface that may be cylindrical. The sleeve's inner surface converges slightly in the direction of its closed end at the same angle as the taper of a conventional cue stick. The sleeve's inner surface is sized to fit snugly over the cue stick tip end. To enable air flow to and from the interior of the sleeve, the sleeve has either longitudinal splines or grooves formed on its inner surface.

The knob, which may serve a decorative purpose along with its functional purpose, is attached to the closed end of the sleeve. The knob enables a player to grasp it and pull the cue tip cap from the cue stick with ease.

In one embodiment, the sleeve closed end includes a stud, and the knob is threaded onto the stud. The stud may be molded integrally with the sleeve, or the stud may be a separate piece captured within the sleeve closed end. In that latter case, a layer of felt, cork, or a similar cushioning material may be placed inside the sleeve to protect the tip of the cue stick from the stud. In another embodiment, the stud is fabricated with the knob and screwed into threads formed inside the end of the sleeve.

The present invention, using a flexible sleeve having a slightly angled inner diameter, thus protects a cue stick tip from damage. It can be used on a cue stick whether it is in or out of its carrying case. The cue tip cap further prevents chalk on the tip from falling into the cue stick carrying case.

Other advantages, benefits, and features of the present invention will become apparent to those skilled in the art upon reading the detailed description of the invention.

DETAILED DESCRIPTION OF THE PREFERRED EMBODIMENT

Figure 1:
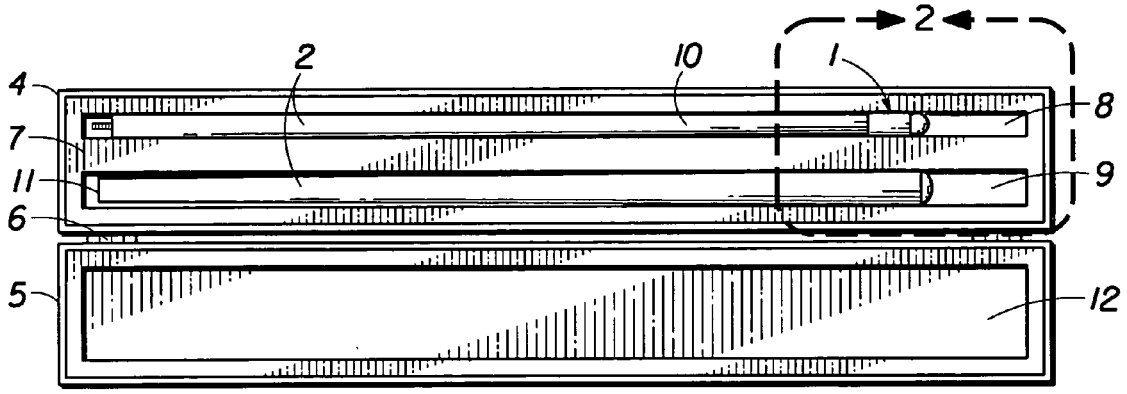
FIG. 1 is a top view of a cue stick with a cue tip cap of the present invention, held in an open carrying case.
Figure 2:
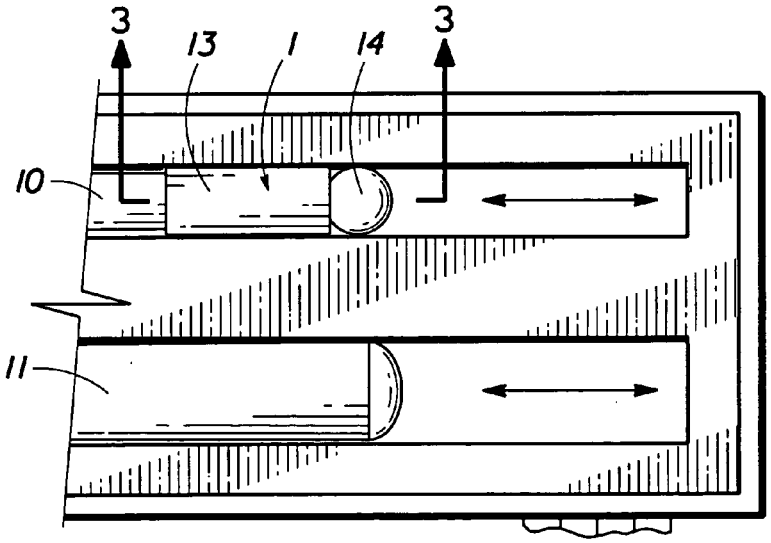
FIG. 2 is a detail of the cue tip cap.

Referring to FIGS. 1 and 2, a cue tip cap 1 of the present invention is shown in use on the end of a cue stick 2, which is used in the games of pool and billiards. Reference numeral 3 represents a typical carrying case for a cue stick 2. The particular carrying case 3 illustrated has a box section 4 that includes a rigid floor and four side walls. A cover 5 is openable and closeable on the box section 4 by means of hinges 6. The box section 4 is lined with a block 7 made of foam rubber or a similar deformable, yet protective material. The block 7 is formed with first and second elongated pockets 8, 9, respectively. The first pocket 8 holds the tip section 10 of the cue stick 2, and the second pocket 9 holds the handle section 11 of the cue stick 2. The cover 5 has a liner 12 of protective material similar to that of the block 7. When the cover 5 is closed, the cue stick 2 is gripped gently but firmly between the foam block 7 and the liner 12.

In accordance with the present invention, the tip of the cue stick 2 is protected by the cue tip cap 1. For that purpose, the cue tip cap 1 is comprised of a sleeve 13 made from a soft rubber or a deformable plastic material, such as plastic. The sleeve 13 has an outer surface, which is typically cylindrical, and an inner surface that is slightly fructo-conical in shape. The inner surface of the sleeve 13 has a diameter allowing it to fit over the end of the tip section 10 of the cue stick 2. The inner surface of the sleeve 13 is formed to follow the same angle as the angle of taper of the tip section 10. Attached to the sleeve 13 is a spherical knob 14, which acts as a "handle." The knob 14 is generally made from a hard plastic material, such as polyethylene or polystyrene.

Figure 3:
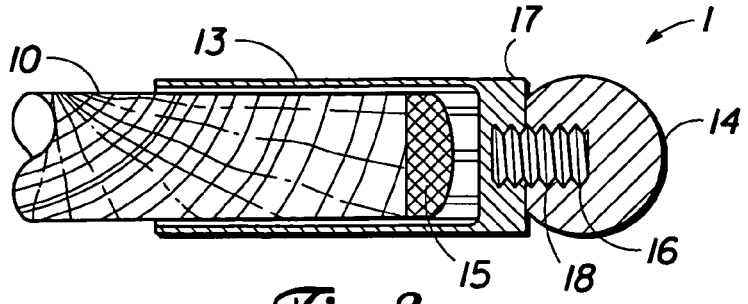
FIG. 3 is a cross-sectional side view of the cue tip cap, taken along line 3—3 of FIG. 2.

The cross-sectional view in FIG. 3 shows the cue tip cap 1 in use. The cue tip cap 1 covers the tip 15 of the cue stick 2. Since chalk dust is often applied to the tip 15, the cue tip cap 1 keeps the chalk dust from falling into the carrying case. As FIG. 3 shows, the sleeve 13 fits snugly around the outer surface of the end of the cue stick 2. The knob 14 is attached to the sleeve 13 with a stud 16, which can be molded as an integral part of either the sleeve 13 or the knob 14, or it can be a separate piece. One end of the stud 16 is embedded in the first end 17 of the sleeve 13, and the other in the knob 14, which can be screwed onto the threaded surface 18 of stud 16. The stud 16 can be made from molded plastic, or it can be made from metal. The cue tip cap 1 is used by pushing its sleeve 13 over the tip 15 and adjacent portion of the tip section 10 of the cue stick 2. The soft material from which the sleeve 13 is made is able to expand the slight amount necessary to enable the sleeve 13 to grip the cue stick 2 with a snug friction fit.

The cue tip cap 1 protects the tip 15 when the cue stick 2 is out of the carrying case. In addition, the cue tip cap 1 protects the tip 15 if the cue stick 2 is stored in a soft-sided carrying case, not shown, but well known to pool and billiards players., The cue tip cap 1 provides the additional benefit of keeping loose chalk dust on the tip 15 from falling into the carrying case, so that the carrying case remains clean and free of chalk dust. The knob 14 provides a hand grasp for easy pulling of the cue tip cap 1 off the cue stick 2. In addition, the knob 14 can fulfill a decorative function. It can also be used for promotional purposes, with an imprinted name, logo, or slogan.

Figure 4:
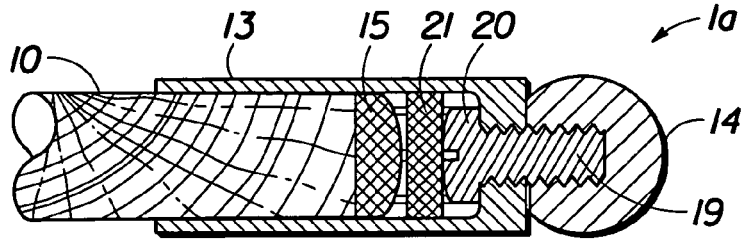
FIG. 4 is a cross-sectional side view of an alternate embodiment of the cue tip cap, also taken along line 3—3 of FIG. 2.

FIG. 4 shows an alternate embodiment of the cue tip cap 1A. A screw 19 is used to hold the knob 14 to the sleeve 13. To protect the tip 15 of the cue stick 2 from the head 20 of the screw 19, a cushion 21, made from felt, cork, or other soft material, is bonded to the head 20 of the screw 19.

Figure 5:
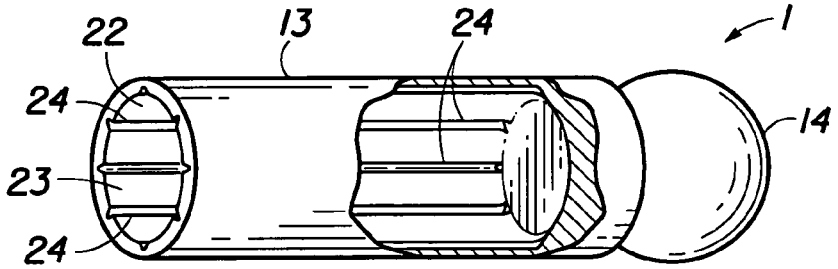
FIG. 5 is a perspective angled side view of a cue tip cap showing grooves on the inside surface of the cap.

FIG. 5 shows the open second end 22 of the sleeve 13, as well as the inner surface 23 of the sleeve 13 of the cue tip cap 1. Longitudinally-extending grooves 24, cut in the inner surface 23 of the sleeve 13, allow air to escape from between the tip 15 of the cue stick 2 and the inner surface 23 of the sleeve 13.

Figure 6:
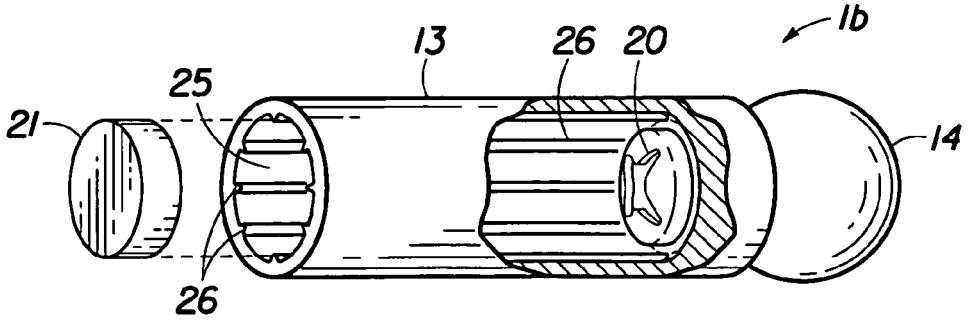
FIG. 6 is a perspective angled side view of another embodiment of a cue tip cap showing splines on the inside surface of the cap.

FIG. 6 shows a cue tip cap 1B having a sleeve 13 with an alternate design for its inner surface 25. The inner surface 25 of the sleeve 13 is provided with a series of longitudinally extending splines 26. The splines 26 allow the sleeve 13 to fit snugly over the tip section 10 of the cue stick 2 when the cue tip cap 1B is pushed onto it. Further, the splines 26 create an air gap to allow air to escape from between the tip 15 of the cue stick 2 and the inner surface of the sleeve 13. FIG. 6 also shows the cushion 21 which can be bonded to the head 20 of the screw 19.

Figure 7:
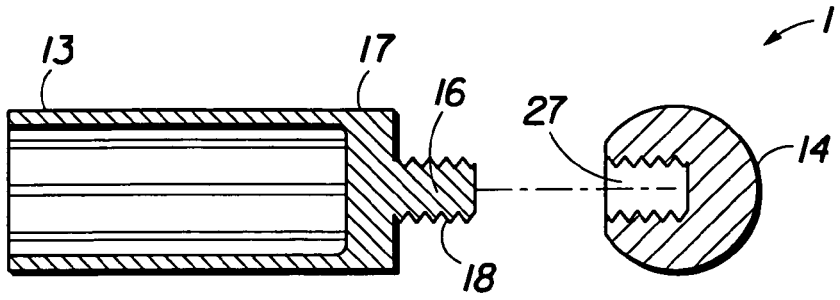
FIGS. 7 through 10 are cross-sectional exploded side views of different embodiments of the cue tip cap of the present invention, showing different means of assembling the parts of the device.

As shown in FIG. 7 through FIG. 10, the cue tip cap 1 can be assembled in a number of ways. As shown in FIG. 7, the stud 16 can be molded as part of the first end 17 of the sleeve 13, and the knob 14 has a cylindrical cavity 27, which is threaded onto the threaded surface 18 of the stud 16.

Figure 8:
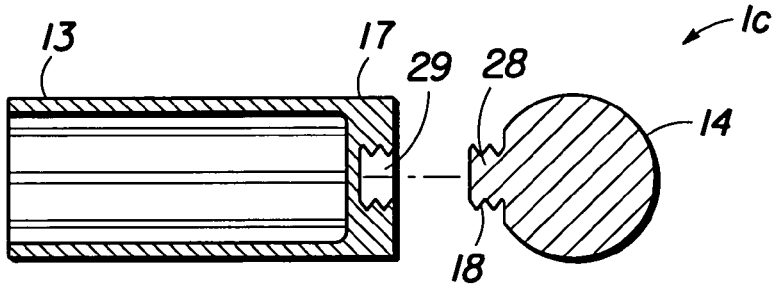

To make the cue tip cap 1C shown in FIG. 8, the stud 28 can be molded as part of the knob 14, and the threaded surface 18 of the stud 28 is threaded into a cavity 29 in the first end 17 of the sleeve 13.

Figure 9:
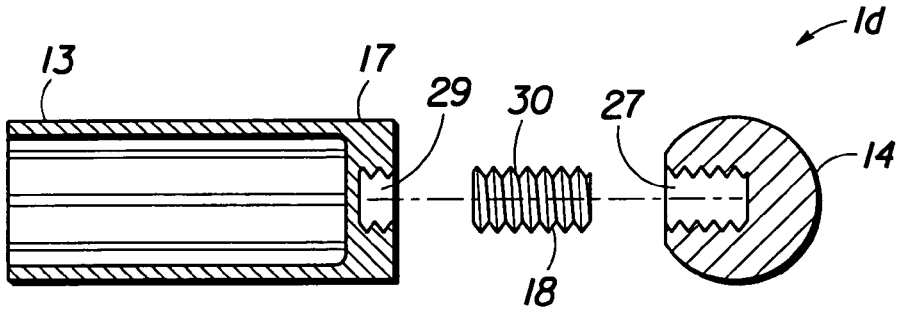

For the cue tip cap 1D shown in FIG. 9, the stud 30 with a threaded surface 18 is a separate piece. One end of the stud 30 is threaded into a cylindrical cavity 27 in the knob 14, and the other end of the stud 30 is threaded into a cavity 29 in the first end 17 of the sleeve 13.

Figure 10:
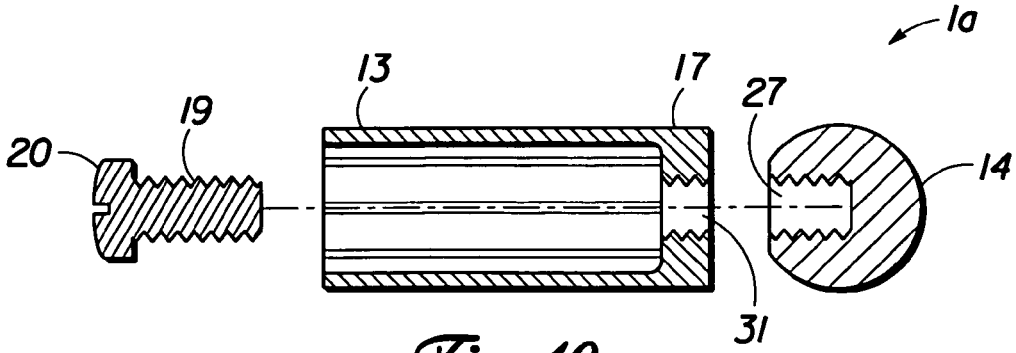

For the cue tip cap 1A shown in FIG. 10, the stud 16 has been replaced by a screw 19 with a head 20. The end of the screw 19 is screwed through an opening 31 in the first end 17 of the sleeve 13, and then screwed into a cylindrical cavity 27 in the knob 14.

Figure 11:
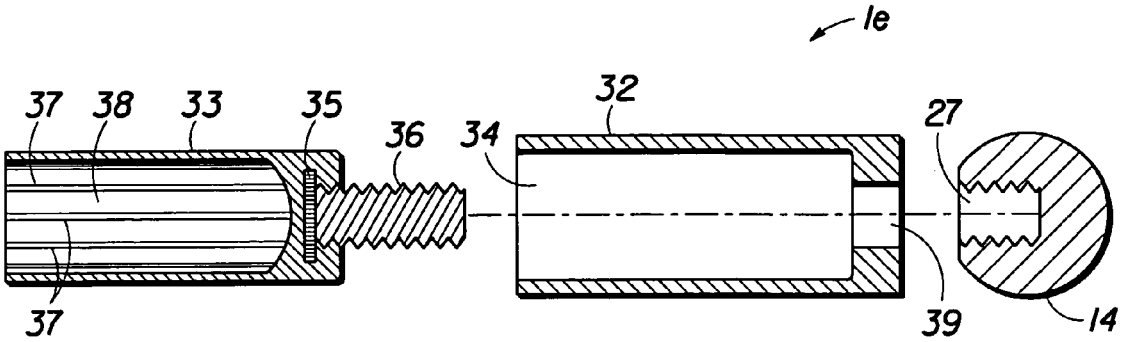
FIG. 11 is a cross-sectional exploded side view of yet another embodiment of a cue tip cap having a hard sleeve with a soft insert.
Figure 12:
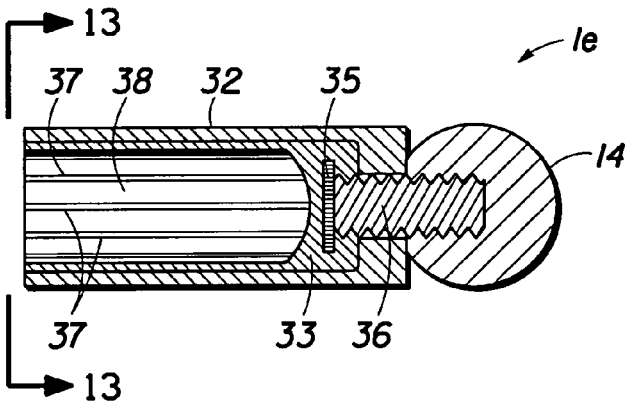
FIG. 12 is a cross-sectional side view of the assembled embodiment of the cue tip cap shown in FIG. 11.
Figure 13:
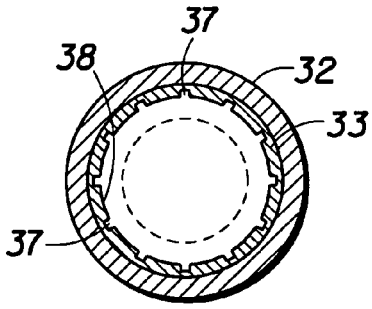
FIG. 13 is a cross-sectional view of the cue tip cap shown in FIG. 12 taken along line 13—13.

As shown in FIG. 11 through FIG. 13, yet another embodiment of the invention shows a cue tip cap 1E, having a hard sleeve 32 with a soft insert 33. The hard sleeve 32, which is cylindrical in shape, is generally made of the same hard plastic material, such as polyethylene or polystyrene, as the knob 14. The knob 14 can also be made from other hard materials, such as crystal or metal. The soft insert 33 is a sleeve made from a deformable material such as soft rubber or plastic, and it is sized to fit inside the bore 34 of the hard sleeve 32. The first end of the soft insert 33 is molded with the head 35 of a brass screw 36 embedded therein. Longitudinally-extending grooves 37, cut in the inner surface 38 of the soft insert 33, allow air to escape from between the tip 15 of the cue stick 2 and the inner surface 38 of the soft insert 33.

In assembling the cue tip cap 1E, the soft insert 33 is pushed into the bore 34 of the hard sleeve 32, and the end of the screw 36 is screwed through an opening 39 in the hard sleeve 32, and then screwed into a cylindrical cavity 27 in the knob 14. As shown in FIG. 12, the deformable soft insert 33 fits snugly inside the hard sleeve 32, which provides a firm surface for the user to handle. FIG. 13 shows the grooves 37 in the inner surface 38 of the soft insert 33 inside the hard sleeve 34.

In summary, the cue tip cap 1 of the present invention provides both protection to the vulnerable tip of a cue stick 2 and neatness to a cue stick carrying case 3. This desirable result comes from using the combined functions of the sleeve 13 and the knob 14. The sleeve 13 grips the tip 15 of the cue stick 2 with a snug friction fit. The cue tip cap 1 protects the tip 15 whenever it is on the cue stick 2, both in and out of a carrying case 3. The cue tip cap also captures chalk dust that otherwise would flake off the tip 15 into the carrying case 3.

It will also be recognized that in addition to the superior performance of the invention, its construction is such as to be of very modest cost. Consequently, it is affordable by almost all pool and billiards players regardless of their level of skill. Also, since the design is simple and made of rugged components, the need for maintenance is minimal.

Thus, it is apparent that there has been provided, in accordance with the invention, a cue tip cap 1 that fully satisfies the aims and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

Although the disclosure hereof is detailed and exact to enable those skilled in the art to practice the invention, the physical embodiments herein disclosed merely exemplify the invention, which may be embodied in other specific structures. The scope of the invention is defined in the claims appended hereto.

I claim:

1. A unitary cue tip cap for use with a cue stick having an end with a tip having an outer diameter, the cue tip cap comprising:

a generally cylindrical sleeve having an open second end and a first end having an opening and an outer surface and an inner surface formed to be spaced a short distance away from the tip of the cue stick when used, the sleeve having an inner diameter capable of closely accommodating the outer diameter of the tip of the cue stick;

a knob having a cylindrical cavity formed with receiving threads;

means for attaching the knob to the outer surface of the first end of the sleeve, the means comprising a screw having a threaded shank and a head, the screw being inserted into the sleeve through the open second end of the outer sleeve, and the threaded shank screwed through the opening in the first end of the sleeve and into the cavity in the knob, the head of the screw being held inside the sleeve; and a small cushion held in place against the head of the screw inside the sleeve;

a person holding the knob when pushing the open second end of the sleeve over the tip of the cue stick and when pulling the sleeve off the end of the cue stick.

2. The cue tip cap claim 1 wherein the cylindrical sleeve has an inner surface that is slightly frusto-conical in shape.

3. The cue tip cap of claim 2 wherein the inner surface is formed with a plurality of longitudinal grooves extending generally between the first end of the sleeve and the open second end of the sleeve.

4. The cue tip cap of claim 2 wherein the inner surface is formed with a plurality of longitudinal splines extending generally between the first end of the sleeve and the open second end of the sleeve.

5. A unitary cue tip cap for use with a cue stick having an end with a tip having an outer diameter, the cue tip cap comprising:

a generally cylindrical inner sleeve having an open second end and a first end having an inner surface formed to be spaced a short distance away from the tip of the cue stick when used, the sleeve having an inner diameter capable of closely accommodating the outer diameter of the tip of the cue stick;

a threaded stud having a first end and a second end, the first end of the stud being embedded in the first end of the inner sleeve and the second end of the stud extending outwardly from the first end of the inner sleeve along a longitudinal axis;

an outer sleeve having a first end with an opening and an open second end, the sleeve having an inner surface formed to accommodate the inner sleeve, the outer sleeve made from a hard plastic material and the inner sleeve made from a deformable material;

a knob having a cylindrical cavity formed with receiving threads;

the inner sleeve being inserted into the outer sleeve through the open second end of the outer sleeve, and the second end of the stud being threaded through the opening in the first end of the outer sleeve and then threaded into the cavity in the knob; a person holding the knob when pushing the open end of the inner sleeve of the cue tip cap over the tip of the cue stick and when pulling the cue tip cap off the end of the cue stick.

6. The cue tip cap of claim 5 wherein the cylindrical inner sleeve has an inner surface that is slightly frusto-conical in shape.

7. The cue tip cap of claim 6 wherein the inner surface of the inner sleeve is formed with a plurality of longitudinal grooves extending generally between the first end of the inner sleeve and the open second end of the inner sleeve.

8. The cue tip cap of claim 6 wherein the inner surface of the inner sleeve is formed with a plurality of longitudinal splines extending generally between the first end of the inner sleeve and the open second end of the inner sleeve.

* * * * *